US005937865A

United States Patent [19]

Dhaliwal

[11] Patent Number: 5,937,865

[45] Date of Patent: Aug. 17, 1999

[54] HAIR COLORING APPLICATOR

[76] Inventor: Namneet K. Dhaliwal, 1507 Alexander, Brea, Calif. 92821

[21] Appl. No.: 09/282,244

[22] Filed: Mar. 31, 1999

[51] Int. Cl.[6] ..... A45D 24/22

[52] U.S. Cl. ..... 132/114; 132/112; 401/268

[58] Field of Search ..... 132/108, 109, 132/110, 112, 113, 114, 115, 116; 401/183, 268, 17, 25, 26, 27, 28

[56] References Cited

U.S. PATENT DOCUMENTS

| | | | |
|---|---|---|---|
| 655,816 | 8/1900 | Vogel | 132/114 |
| 666,759 | 1/1901 | Knickerbocker | 401/28 |
| 1,014,465 | 1/1912 | Hall | 132/114 |
| 1,570,013 | 1/1926 | Smith | 132/114 |
| 1,615,581 | 1/1927 | Harris | 132/116 |
| 2,956,570 | 10/1960 | Stanford | 132/116 |
| 4,055,195 | 10/1977 | Moses | 132/115 |
| 4,143,667 | 3/1979 | Peilet | 401/28 |
| 4,323,085 | 4/1982 | Rohm | 132/113 |
| 4,566,472 | 1/1986 | Mueller | 132/112 |
| 4,747,420 | 5/1988 | Alaimo | 132/112 |
| 4,872,594 | 10/1989 | Bloom | 222/173 |
| 5,054,504 | 10/1991 | Winrow | 132/114 |
| 5,146,936 | 9/1992 | Ng | 132/208 |
| 5,311,887 | 5/1994 | Ramsey | 132/114 |

*Primary Examiner*—Gene Mancene
*Assistant Examiner*—Pedro Philogene
*Attorney, Agent, or Firm*—Goldstein & Canino

[57] ABSTRACT

A hair coloring applicator including a hair dye tube adapted for holding a quantity of hair coloring therein. The hair dye tube receives the hair coloring therein. The hair dye tube has an open port extending outwardly therefrom. The open port is in communication with the hollow interior. A comb portion is provided that is adapted for coupling with open port of the hair dye tube. The comb portion includes a housing comprised of a hollow interior defined by an upper wall, a lower wall, and a peripheral side wall therebetween. The housing has a feed duct extending upwardly from the upper wall thereof. The feed duct is in communication with the hollow interior of the housing. The feed duct has an open upper end for coupling with the open port of the hair dye tube. The housing has a plurality of hollow bristles extending downwardly from the lower wall thereof. The hollow bristles are in communication with the hollow interior of the housing. Each of the hollow bristles have a plurality of pores therein in a spaced relationship whereby hair coloring from the hair dye tube is dispensed through the open port into the housing through the feed duct and out through the pores of the plurality of bristles for application on strands of a user's hair.

6 Claims, 3 Drawing Sheets

HAIR COLORING APPLICATOR

BACKGROUND OF THE INVENTION

The present invention relates to a hair coloring applicator and more particularly pertains to dispersing hair coloring across a users hair uniformly.

Typical color-applying combs are constructed like a normal comb with rough teeth. To color strands of hair, the inner ends of the gaps between the teeth are filled with a hair dye and the comb is then pulled through the hair. Thus, the dye is applied to the strands of hair which slide between the teeth. Since, however, the tooth gaps lie relatively close to each other and they also receive a relatively large number of strands of hair, a relatively extensive application of the hair dye results, so that too much hair is colored and not in the form of separate strands. Furthermore, the narrow gaps between the teeth can only hold a relatively small amount of the hair dye, so that when the hair is relatively long, the quantity of hair dye is not sufficient to color strands of hair over the entire length. Also the gaps must be refilled with hair dye each time the comb is pulled through the hair.

The present invention seeks to provide a solution to these problems by providing a hair coloring applicator that is capable of dispersing hair coloring across the strands of hair uniformly and can utilizes light pressure and gravity to draw the coloring out through the device and on to the hair strands.

The use of hair coloring devices is known in the prior art. More specifically, hair coloring devices heretofore devised and utilized for the purpose of coloring hair are known to consist basically of familiar, expected and obvious structural configurations, notwithstanding the myriad of designs encompassed by the crowded prior art which have been developed for the fulfillment of countless objectives and requirements.

By way of example, U.S. Pat. No. 2,956,570 to Stanford discloses a hair treatment device comprised of a comb with a supply container incorporated. U.S. Pat. No. 4,055,195 to Moses discloses a hair comb with a fluid reservoir attached. U.S. Pat. No. 4,747,420 to Alaimo discloses a comb for use in applying dye to hair utilizing saturated pipe cleaner. U.S. Pat. No. 4,566,472 to Mueller and 5,146,936 to Ng disclose additional combs used for hair coloring.

While these devices fulfill their respective, particular objective and requirements, the aforementioned patents do not describe a hair coloring applicator for dispersing hair coloring across a users hair uniformly.

In this respect, the hair coloring applicator according to the present invention substantially departs from the conventional concepts and designs of the prior art, and in doing so provides an apparatus primarily developed for the purpose of dispersing hair coloring across a users hair uniformly.

Therefore, it can be appreciated that there exists a continuing need for new and improved hair coloring applicator which can be used for dispersing hair coloring across a users hair uniformly. In this regard, the present invention substantially fulfills this need.

SUMMARY OF THE INVENTION

In the view of the foregoing disadvantages inherent in the known types of hair coloring devices now present in the prior art, the present invention provides an improved hair coloring applicator. As such, the general purpose of the present invention, which will be described subsequently in greater detail, is to provide a new and improved hair coloring applicator and method which has all the advantages of the prior art and none of the disadvantages.

To attain this, the present invention essentially comprises a hair dye tube adapted for holding a quantity of hair coloring therein. The hair dye tube has a generally cylindrical configuration with an open upper end, a closed lower end, and a hollow interior. The open upper end receives the hair coloring therein for storage within the hollow interior. The hair dye tube has a circular flange extending around a periphery thereof intermediate the open upper end and the closed lower end thereof. The closed lower end has an open port extending outwardly therefrom. The open port is in communication with the hollow interior. The hair dye tube includes a plunger portion receivable within the open upper end thereof. A comb portion is provided that is adapted for coupling with open port of the hair dye tube. The comb portion includes a housing comprised of a hollow interior defined by an upper wall, a lower wall, and a peripheral side wall therebetween. The housing further has a rectangular central portion and a pair of triangular side portions. Outer apexes of the triangular side portions have guard walls extending downwardly therefrom. The housing has a feed duct extending upwardly from the upper wall thereof. The feed duct is in communication with the hollow interior of the housing. The feed duct has an open upper end for coupling with the open port of the hair dye tube. The housing has a plurality of hollow bristles extending downwardly from the lower wall thereof. The hollow bristles are in communication with the hollow interior of the housing. Each of the hollow bristles have a plurality of pores therein in a spaced relationship whereby hair coloring from the hair dye tube is dispensed through the open port into the housing through the feed duct and out through the pores of the plurality of bristles for application on strands of a user's hair.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hair coloring applicator which has all the advantages of the prior art hair coloring devices and none of the disadvantages.

It is another object of the present invention to provide a new and improved hair coloring applicator which may be easily and efficiently manufactured and marketed.

It is a further object of the present invention to provide a new and improved hair coloring applicator which is of durable and reliable construction.

An even further object of the present invention is to provide a new and improved hair coloring applicator which is susceptible of a low cost of manufacture with regard to both materials and labor, and which accordingly is then susceptible of low prices of sale to the consuming public, thereby making such a hair coloring applicator economically available to the buying public.

Even still another object of the present invention is to provide a new and improved hair coloring applicator for dispersing hair coloring across a users hair uniformly.

Lastly, it is an object of the present invention to provide a new and improved hair coloring applicator including a hair dye tube adapted for holding a quantity of hair coloring therein. The hair dye tube has a generally cylindrical configuration with an open upper end, a closed lower end, and a hollow interior. The open upper end receives the hair coloring therein for storage within the hollow interior. The closed lower end has an open port extending outwardly therefrom. The open port is in communication with the hollow interior. A comb portion is provided that is adapted for coupling with open port of the hair dye tube. The comb portion includes a housing comprised of a hollow interior defined by an upper wall, a lower wall, and a peripheral side wall therebetween. The housing has a feed duct extending upwardly from the upper wall thereof. The feed duct is in communication with the hollow interior of the housing. The feed duct has an open upper end for coupling with the open port of the hair dye tube. The housing has a plurality of hollow bristles extending downwardly from the lower wall thereof. The hollow bristles are in communication with the hollow interior of the housing. Each of the hollow bristles have a plurality of pores therein in a spaced relationship whereby hair coloring from the hair dye tube is dispensed through the open port into the housing through the feed duct and out through the pores of the plurality of bristles for application on strands of a user's hair.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
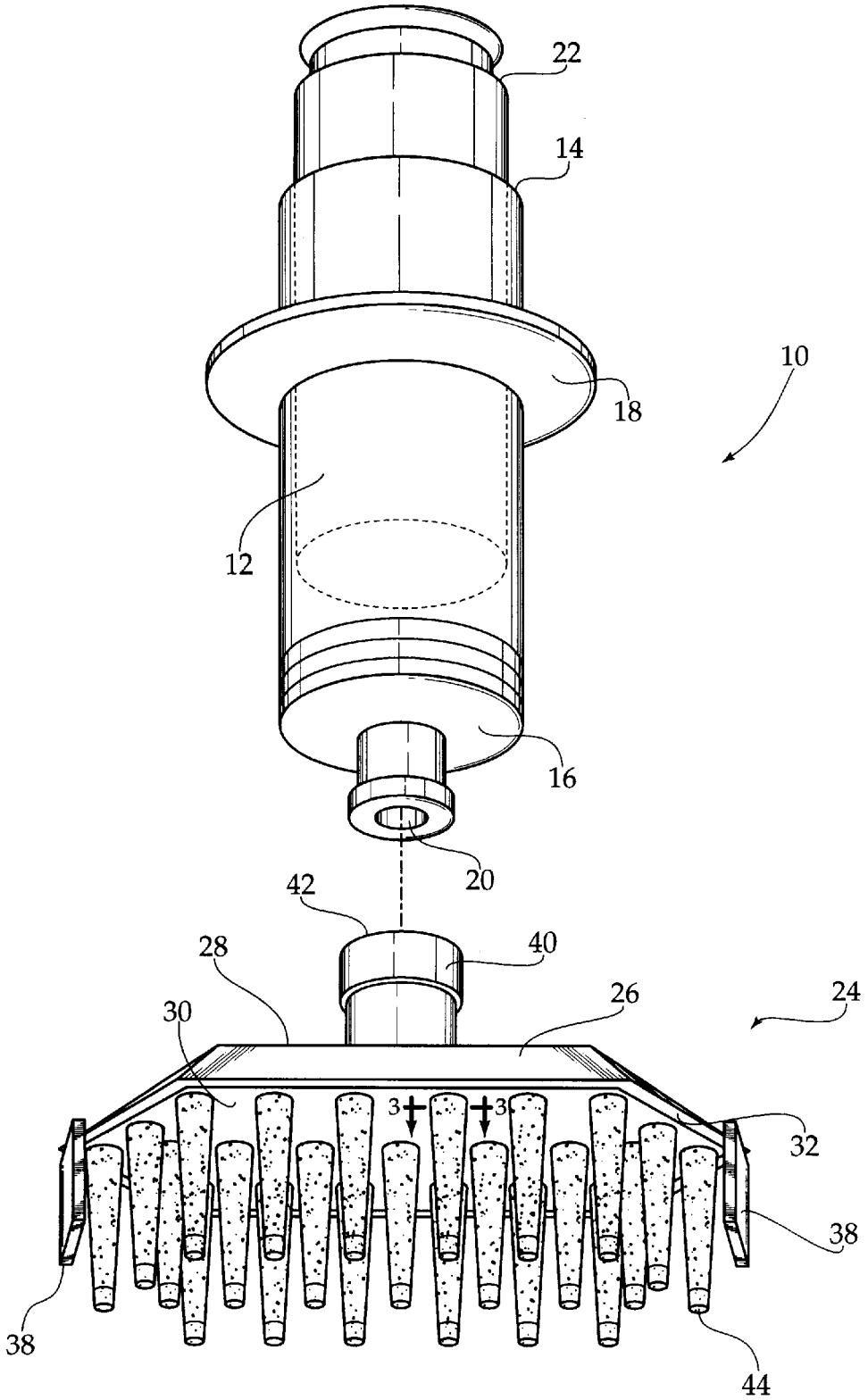
FIG. 1 is a perspective view of the preferred embodiment of the hair coloring applicator constructed in accordance with the principles of the present invention.
Figure 2:
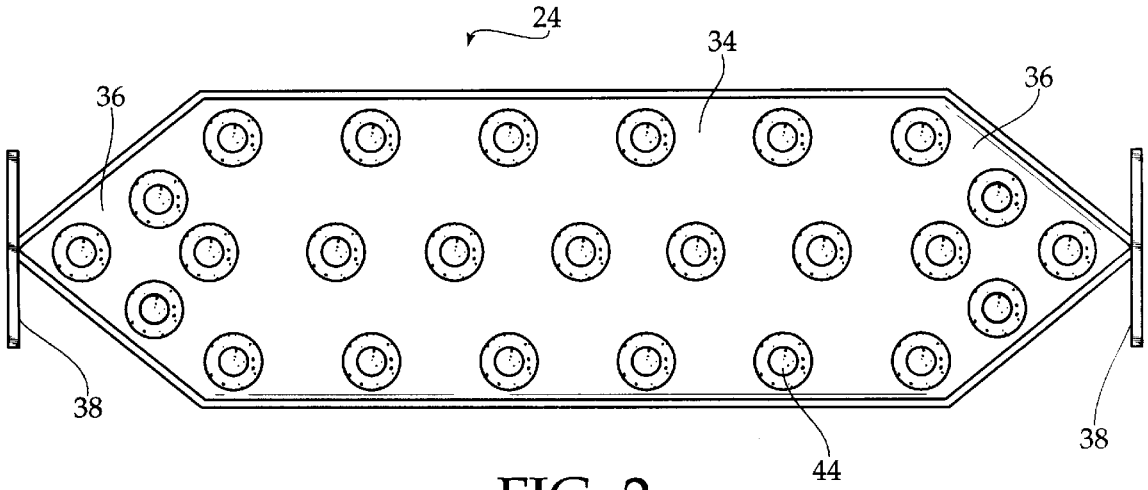
FIG. 2 is a bottom plan view of the comb portion of the present invention.
Figure 3:
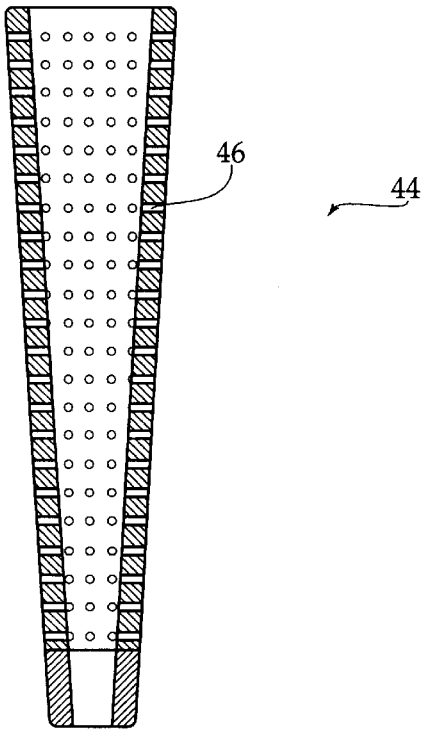
FIG. 3 is a cross-sectional view of the present invention as taken along line 3—3 of FIG. 1.

With reference now to the drawings, and in particular, to FIGS. 1 through 4 thereof, the preferred embodiment of the new and improved hair coloring applicator embodying the principles and concepts of the present invention and generally designated by the reference number 10 will be described.

Specifically, it will be noted in the various Figures that the device relates to a hair coloring applicator for dispersing hair coloring across a users hair uniformly. In its broadest context, the device consists of a hair dye tube and a comb portion. Such components are individually configured and correlated with respect to each other so as to attain the desired objective.

The hair dye tube 12 is adapted for holding a quantity of hair coloring therein. The hair dye tube 12 has a generally cylindrical configuration with an open upper end 14, a closed lower end 16, and a hollow interior. The open upper end 14 receives the hair coloring therein for storage within the hollow interior. The hair dye tube 12 has a circular flange 18 extending around a periphery thereof intermediate the open upper end 14 and the closed lower end 16 thereof. The circular flange 18 will aid the user in the handling of the device 10. The closed lower end 16 has an open port 20 extending outwardly therefrom. The open port 20 is in communication with the hollow interior. The open port 20 could be provided with a small cap or the like to preclude the flow of hair coloring outwardly thereof when not in use or detached from the comb portion. The hair dye tube 12 includes a plunger portion 22 receivable within the open upper end 14 thereof. The plunger portion 22 will be utilized to force hair coloring within the hair dye tube 12 outwardly through the open port 22 and into to the comb portion which will be further discussed hereinafter. Note FIG. 1.

The comb portion 24 is adapted for coupling with open port 20 of the hair dye tube 12. The comb portion 24 includes a housing 26 comprised of a hollow interior defined by an upper wall 28, a lower wall 30, and a peripheral side wall 32 therebetween. The housing 26 further has a rectangular central portion 34 and a pair of triangular side portions 36. Outer apexes of the triangular side portions 36 have guard walls 38 extending downwardly therefrom. Note FIG. 2. The housing 26 has a feed duct 40 extending upwardly from the upper wall 28 thereof. The feed duct 40 is in communication with the hollow interior of the housing 26. The feed duct 40 has an open upper end 42 for coupling with the open port 20 of the hair dye tube 12. The housing 26 has a plurality of hollow bristles 44 extending downwardly from the lower wall 30 thereof. The hollow bristles 44 are in communication with the hollow interior of the housing 26. Note FIG. 3. Each of the hollow bristles 44 have a plurality of pores 46 therein in a spaced relationship whereby hair coloring from the hair dye tube 12 is dispensed through the open port 20 into the housing 26 through the feed duct 40 and out through the pores 46 of the plurality of bristles 44 for application on strands of a user's hair.

Figure 4:
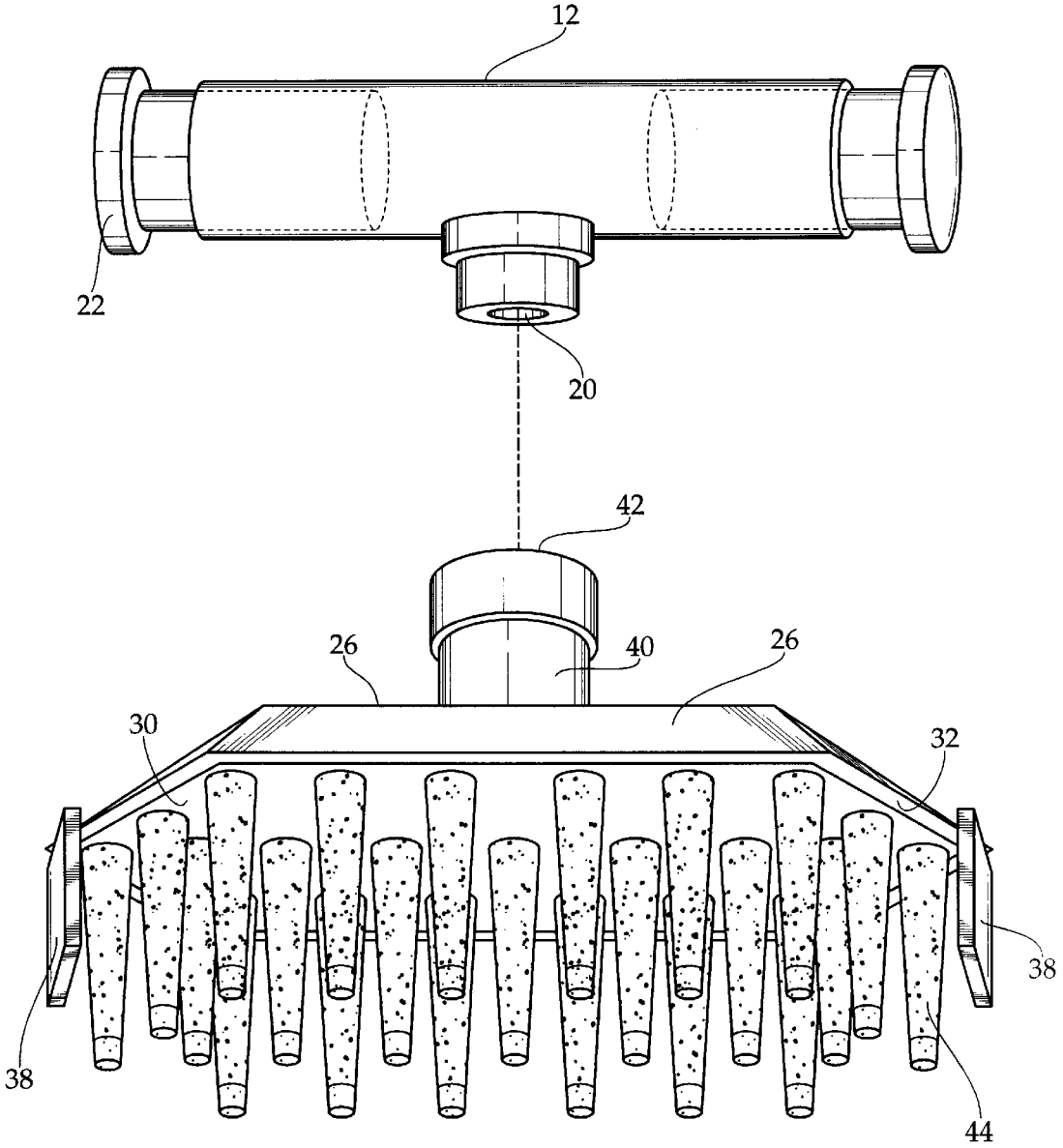
FIG. 4 is a perspective view of the present invention illustrating an alternate design for the hair dye tube thereof.

A second embodiment of the present invention is shown in FIG. 4 and includes substantially all of the components of the present invention wherein the hair dye tube 12 is provided with open opposite ends and the open port 20 is disposed intermediate the open opposite ends. Thus, the hair dye tube 12 will be held in a horizontal orientation when attached to the comb portion 24. The open opposite ends would each receive a plunger portion 22 whereby pressure from both ends could be applied pushing the hair dye into the open port 20 for dispersing into the comb portion 24.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A hair coloring applicator for dispersing hair coloring across a users hair uniformly comprising, in combination:

a hair dye tube adapted for holding a quantity of hair coloring therein, the hair dye tube having a generally cylindrical configuration with an open upper end, a closed lower end, and a hollow interior, the open upper end receiving the hair coloring therein for storage within the hollow interior, the hair dye tube having a circular flange extending around a periphery thereof intermediate the open upper end and the closed lower end thereof, the closed lower end having an open port extending outwardly therefrom, the open port being in communication with the hollow interior, the hair dye tube including a plunger portion receivable within the open upper end thereof;

a comb portion adapted for coupling with open port of the hair dye tube, the comb portion including a housing comprised of a hollow interior defined by an upper wall, a lower wall, and a peripheral side wall therebetween, the housing further having a rectangular central portion and a pair of triangular side portions, outer apexes of the triangular side portions having guard walls extending downwardly therefrom, the housing having a feed duct extending upwardly from the upper wall thereof, the feed duct being in communication with the hollow interior of the housing, the feed duct having an open upper end for coupling with the open port of the hair dye tube, the housing having a plurality of hollow bristles extending downwardly from the lower wall thereof, the hollow bristles being in communication with the hollow interior of the housing, each of the hollow bristles having a plurality of pores therein in a spaced relationship whereby hair coloring from the hair dye tube is dispensed through the open port into the housing through the feed duct and out through the pores of the plurality of bristles for application on strands of a user's hair.

2. A hair coloring applicator for dispersing hair coloring across a users hair uniformly comprising, in combination:

a hair dye tube adapted for holding a quantity of hair coloring therein, the hair dye tube having a generally cylindrical configuration with at least one open end and a hollow interior, the open end receiving the hair coloring therein for storage within the hollow interior, the hair dye tube having an open port extending outwardly therefrom, the open port being in communication with the hollow interior;

a comb portion adapted for coupling with open port of the hair dye tube, the comb portion including a housing comprised of a hollow interior defined by an upper wall, a lower wall, and a peripheral side wall therebetween, the housing having a feed duct extending upwardly from the upper wall thereof, the feed duct being in communication with the hollow interior of the housing, the feed duct having an open upper end for coupling with the open port of the hair dye tube, the housing having a plurality of hollow bristles extending downwardly from the lower wall thereof, the hollow bristles being in communication with the hollow interior of the housing, each of the hollow bristles having a plurality of pores therein in a spaced relationship whereby hair coloring from the hair dye tube is dispensed through the open port into the housing through the feed duct and out through the pores of the plurality of bristles for application on strands of a user's hair.

3. The hair coloring applicator as set forth in claim 2 wherein the hair dye tube has a circular flange extending around a periphery thereof intermediate the open upper end and the closed lower end thereof.

4. The hair coloring applicator as set forth in claim 2 wherein the hair dye tube includes at least one plunger portion receivable within the at least one open end thereof.

5. The hair coloring applicator as set forth in claim 2 wherein the housing of the comb portion has a rectangular central portion and a pair of triangular side portions.

6. The hair coloring applicator as set forth in claim 5 wherein outer apexes of the triangular side portions have guard walls extending downwardly therefrom.

* * * * *